US009797628B2

(12) United States Patent
Adler et al.

(10) Patent No.: US 9,797,628 B2
(45) Date of Patent: Oct. 24, 2017

(54) DEVICE AND METHOD FOR CONVERTING THERMAL ENERGY

(75) Inventors: Bernhard Adler, Gramatneusiedl (AT); Sebastian Riepl, Vienna (AT)

(73) Assignee: ECOP TECHNOLOGIES GMBH, Linz (AT)

( * ) Notice: Subject to any disclaimer, the term of this patent is extended or adjusted under 35 U.S.C. 154(b) by 682 days.

(21) Appl. No.: 13/695,756

(22) PCT Filed: May 9, 2011

(86) PCT No.: PCT/AT2011/000217
§ 371 (c)(1),
(2), (4) Date: Nov. 1, 2012

(87) PCT Pub. No.: WO2011/137476
PCT Pub. Date: Nov. 10, 2011

(65) Prior Publication Data

US 2013/0042994 A1 Feb. 21, 2013

(30) Foreign Application Priority Data

May 7, 2010 (AT) ..... 775/2010

(51) Int. Cl.
*F25B 3/00* (2006.01)
*F25B 9/00* (2006.01)

(52) U.S. Cl.
CPC . *F25B 3/00* (2013.01); *F25B 9/00* (2013.01)

(58) Field of Classification Search
CPC ..... F25B 3/00; F25B 9/00
(Continued)

(56) References Cited

U.S. PATENT DOCUMENTS 3,828,573 A 8/1974 Eskeli
3,933,008 A * 1/1976 Eskeli ..... 165/88
(Continued)

FOREIGN PATENT DOCUMENTS

AT 509231 A4 7/2011
GB 1466580 A 3/1977
WO WO 2009015402 A1 * 2/2009 ..... F25B 3/00

OTHER PUBLICATIONS

Machine Translation of WO 2009015402 A1, retrieved Feb. 4, 2014.*
International Search Report and Written Opinion for PCT/AT2011/000217 dated Sep. 8, 2011.

*Primary Examiner* — Len Tran
*Assistant Examiner* — Hans Weiland
(74) *Attorney, Agent, or Firm* — Sughrue Mion, PLLC

(57) ABSTRACT

The invention relates to a device (1) and a method for converting thermal energy of low temperature to thermal energy of high temperature by means of mechanical energy and vice versa, said device comprising a rotor (2) that is rotatably supported about a rotational axis (3), a flow channel for a working medium that runs through a closed cycle being provided in the rotor, wherein the flow channel has a compression channel (8), a relaxation channel (10), and two connection channels (9, 11) extending substantially parallel to the rotational axis (3), and furthermore heat exchangers (13, 14) for exchanging heat between the working medium and a heat-exchange medium are provided, wherein the compression channel (8) and the relaxation channel (10) have a heat-exchange segment (8', 10'), each of which has a heat exchanger (13, 14) that rotates together with the compression channel (8) or the relaxation channel (10) associated therewith, said heat exchanger being formed by at least one heat-exchange channel (15, 18) that conducts the heat-exchange medium.

6 Claims, 12 Drawing Sheets

(58) Field of Classification Search
USPC ..... 165/8, 88; 62/115, 499, 502
See application file for complete search history.

(56) References Cited

U.S. PATENT DOCUMENTS

| | | | | | |
|---|---|---|---|---|---|
| 3,981,702 | A * | 9/1976 | Eskeli | F25B 3/00 | 62/499 |
| 4,044,824 | A * | 8/1977 | Eskeli | 165/88 | |
| 4,077,230 | A * | 3/1978 | Eskeli | F25B 3/00 | 415/1 |
| 4,117,695 | A * | 10/1978 | Hargreaves | F25B 3/00 | 417/207 |
| 4,793,154 | A | 12/1988 | Cross et al. | | |
| 5,168,726 | A * | 12/1992 | York | F25B 3/00 | 165/86 |
| 6,261,419 | B1 * | 7/2001 | Zebuhr | 165/88 | |
| 8,316,655 | B2 * | 11/2012 | Adler | 62/86 | |

* cited by examiner

DEVICE AND METHOD FOR CONVERTING THERMAL ENERGY

CROSS REFERENCE TO RELATED APPLICATIONS

This application is a National Stage of International Application No. PCT/AT2011/000217 filed May 9, 2011, claiming priority based on Austrian Patent Application No. A 775/2010 filed May 7, 2010, the contents of all of which are incorporated herein by reference in their entirety.

The present invention relates to a device for converting thermal energy of low temperature into thermal energy of higher temperature by means of mechanical energy and vice versa, comprising a rotor that is rotatably supported about a rotational axis, in which rotor a flow channel for a working medium going through a closed cyclic process is provided, the flow channel comprising a compression channel in which the working medium can be guided essentially radially outwards with respect to the rotational axis to increase the pressure, an expansion channel in which the working medium can be guided essentially radially inwards with respect to the rotational axis to reduce the pressure, and two connection channels extending essentially in parallel to the rotational axis, and furthermore heat exchangers are provided for a heat exchange between the working medium and a heat exchange medium, the compression channel and the expansion channel each comprising a heat exchange portion, allocated to which is a heat exchanger co-rotating with the compression channel and the expansion channel, respectively.

Furthermore, the invention relates to a method for converting thermal energy of low temperature into thermal energy of higher temperature by means of mechanical energy and vice versa, comprising a working medium that rotates about a rotational axis, which working medium goes through a closed thermodynamic cyclic process, the working medium being guided essentially radially outwards during compression with respect to the rotational axis and radially inwards during expansion with respect to the rotational axis, wherein a pressure increase or a pressure decrease in the working medium is generated by the centrifugal acceleration acting on the working medium, and the working medium dissipates heat to a heat exchange medium or receives heat from a heat exchange medium, the heat exchange taking place via a heat exchange medium co-rotating with the working medium about the rotational axis at least partially during compression or expansion, respectively.

From the prior art there are known heat pumps or heat engines, in which a gaseous working medium is guided in a closed thermodynamic cyclic process.

From GB 1 466 580 there is known a heat pump which comprises a rotor disposed within a casing, in which rotor a gaseous fluid goes through a cyclic process. On the compressor side of the rotor, the fluid is guided radially outwards for pressure increase by means of centrifugal force and subsequently passed via a short portion running in parallel to the rotational axis into the expansion side, in which the first fluid flows radially inwards toward the rotational axis. For the heat exchange between the first fluid and a second or third fluid, a heat exchanger is provided on the compressor side and a heat exchanger is provided on the expansion side, which are arranged so as to co-rotate in the rotor. The heat exchangers each comprise several circumferential heat exchange lines spaced in radial direction; the heat exchanger provided for the dissipation of heat from the compressed fluid is radially disposed further outwards than the heat exchanger lying inside on the expansion side. Therefore, the heat exchanger lines extend on the compression or expansion side each transversely to the flow direction of the fluid, i.e. in peripheral direction of the rotor. However, this embodiment has the disadvantage that upon passing through the compressor or expansion side in radial direction, a discontinuous heat exchange takes place, which results in a comparatively high loss of energy.

WO 2009/015402 A1 describes a heat pump, in which the working medium in a pipeline system of a rotor passes through a cyclic process comprising the operations of compression of the working medium, dissipation of heat from the working medium by means of a heat exchanger, expansion of the working medium and heat supply to the working medium by means of a further heat exchanger. The pressure increase or pressure decrease of the working medium is effected by the centrifugal acceleration, the working medium flowing radially outwards in a compression unit and radially inwards in an expansion unit with respect to a rotational axis. The dissipation of heat from the working medium to a heat exchange medium of the heat exchanger takes place in a portion of the pipeline system running axially or in parallel to the rotational axis, allocated to which is a co-rotating heat exchanger comprising the heat exchange medium. Basically, this device enables a very efficient conversion of mechanical energy and thermal energy of lower temperature into thermal energy of higher temperature. In order to ensure the desired dissipation of heat in the axial portion of the pipeline system, however, said portion must have a certain longitudinal extension. This has the disadvantage that the system must not fall below a minimum length in axial direction, so that much unused space remains free in the rotor.

The object of the invention is to provide a device and a method of the above given type, in which a conversion of mechanical energy into thermal energy and vice versa can be obtained with a high degree of efficiency in a space-saving, stable arrangement.

In the device of the above cited type, this is achieved in that the heat exchange channels in the area of the heat exchange portion are arranged adjacent to the compression channel or the expansion channel, respectively, and run essentially in parallel to the compression channel or the expansion channel.

Accordingly, the heat exchange between the working medium and the heat exchange medium takes place in a heat exchange portion of the compression channel or the expansion channel installed especially for a heat exchange with the pertinent heat exchanger and running in radial direction, which portion may extend up to the maximum length of the compression channel or the expansion channel. During the cyclic process, the working medium is preferably present in a gaseous state; however, basically a liquid working medium or a working medium available in a two-phase state is also conceivable. By forming the heat exchange portions in the compression channel or the expansion channel, a particularly space-efficient arrangement can be obtained, because the axial connection channels connecting the compression channel to the expansion channel do not have to fulfil any special task, in particular no heat exchange. In particular, the connection channels—which in known systems are designed with respect to a heat exchange with an axially extending heat exchanger in an especially longitudinal manner—may be comparatively short, since the connection channels according to the invention only need to ensure a deflection into the other compression channel or expansion channel running in radial direction. Therefore, the dimensions of the device according to the invention can be substantially reduced, in particular, in the direction of the rotational axis, as compared to known heat pumps or heat engines. For instance, this allows the series connection of several such devices along a joint rotation axis, the entire performance provided essentially corresponding to the sum of the individual devices. In addition, with the radial arrangement according to the invention of the heat exchanger along the heat exchanger portion of the compression channel or the expansion channel, a rotor of high stability can be obtained, since the radially arranged heat exchangers according to the invention are better suited, as compared to axially extending heat exchangers, to absorb the high centrifugal forces during operation of the rotor. In this manner, the rotor or a drive allocated to the rotor, for example, an electric motor, can be driven at high angular speeds. The compact, rigid design of the device according to the invention allows high circumferential speeds which correspond to high temperature spreads.

The compression channel and the expansion channel just as well as the pertinent heat exchangers are accommodated in the joint rotor and therefore configured for a synchronous rotation about the rotational axis. Therefore, the closed flow channel of the working medium fully extends in the rotating components of the device during the cyclic process. In this manner, flow losses which would occur when introducing or discharging the working medium from the rotor are avoided as far as possible, so that the conversion of thermal energy of low temperatures into thermal energy of higher temperature and vice versa takes place with a high efficiency in the present device.

With regard to an efficient heat exchange, the heat exchange channel, which is provided for realizing the heat exchanger and carries the heat exchange medium, is arranged in the area of the heat exchange portion adjacent to the compression channel or expansion channel and extends essentially in parallel to the compression channel or expansion channel.

To obtain a particularly rigid arrangement being able to withstand the high centrifugal forces during operation, it is favourable if the heat exchange channel and the compression channel or the expansion channel in the heat exchange portion are formed by recesses in a joint, preferably disc-shaped or plate-shaped body. Therefore, the heat exchange channel and the compression channel or the expansion channel in the heat exchange portion are each guided in recesses of the heat exchanger body, a heat exchange taking place between the working medium and the heat exchange medium in recesses which face each other or are opposite each other.

To increase the performance obtainable by the device according to the invention, it is favourable to provide a plurality of compression channels or expansion channels, which are preferably arranged symmetrically about the rotational axis at regular angular distances, as well as heat exchange channels which comprise a heat exchange portion each arranged in a recess of the heat exchanger body. In this embodiment, a conversion of mechanical energy into thermal energy and vice versa may be realised at a high performance and at the same time with little space required. The obtainable performance may be increased further, if several devices according to the invention are connected in series.

Depending on the selected dimensions, in particular the cross-sectional area of the compression channel and the expansion channel, respectively, it may be favourable with regard to an efficient heat exchange, if in the heat exchange portion a compression channel or an expansion channel branches into at least two recesses of the heat exchanger body. Therefore, at least two separate recesses of the heat exchanger body can be allocated to each compression channel and expansion channel, respectively. Preferably, in the area of the transition between the compression channel or the expansion channel and the pertinent recesses of the heat exchanger body, an annular distributing groove is provided. In other embodiments of the rotor, however, the reversed case may be favourable, if at least two compression channels or expansion channels, respectively, are formed in a joint recess of the heat exchanger body.

To obtain an efficient heat exchange between the working medium and the heat exchange medium in the respective heat exchanger body, it is of advantage to arrange fins on sides lying opposite with regard to the main extension plane of the heat exchanger body, between which the recesses which are open to the outside with regard to the heat exchanger body, are arranged to form the compression channels or expansion channels or heat exchange channels in the heat exchange portion.

To obtain a heat exchanger body suitable for high centrifugal forces (high circumferential speeds) it is favourable if the fins project from an all-over wall on both sides, the wall thickness preferably amounts to between 1 mm and 20 mm. On opposite sides of the all-over wall, a plurality of fins separate a corresponding number of recesses. In the heat exchanger provided for the dissipation of heat from the working medium, the heat exchange portions of heat exchange channels and compression channels, respectively, are formed in adjacent, opposite recesses; correspondingly, the heat exchange portions of the heat exchange channels are lying opposite those of the expansion channels in the heat exchanger provided for the heat supply to the working medium.

With regard to an expedient heat exchange in the heat exchanger body, it is favourable if the width of the fins essentially corresponds to a width of the recesses.

Examinations of the heat flows in the heat exchanger body have shown that the heat conduction losses are low or the stability with respect to differential pressures is high, if the fins or recesses of the heat exchanger plate or disk are arranged offset to one another in tangential direction, the offset corresponding to the width of a recess and a fin, respectively, so that in each case a fin and a recess are opposite each other.

To obtain a stable heat exchanger body, which at the same time has a good thermal conductivity, it is favourable if the heat exchanger body consists of a material having high strength and high thermal conductivity or low material density, preferably aluminium or fibre-reinforced plastic material.

With regard to an uncomplicated manufacture of the heat exchanger body, where also a particularly precise adaptation of the recesses is enabled, it is of advantage if the recesses of the heat exchanger body are formed by a milling process. In an alternative embodiment, the recesses of the heat exchanger body are produced by a casting method.

To obtain efficient heat transfer in the heat exchange portion of the compression channel and the expansion channel, respectively, a preferred embodiment provides that a plate heat exchanger having a housing is provided as heat exchanger, in which plates are arranged in a manner separated by spaces, in which the working medium and the heat exchange medium is carried alternately. Accordingly, such a plate heat exchanger comprises a plurality of plates which are arranged in the housing in such a way that the heat exchange medium or the working medium flows in the successive spaces. The plates which, for instance, are soldered or screwed to one another are sealed towards the outside and each towards the adjacent spaces for the other medium.

A basic disadvantage of plate heat exchangers lies in their low pressure stability. During use of the device, high internal pressures occur in the plate heat exchanger, which cause form changes or deflections of the plates. In the case of very high pressures, the load limit of the plate heat exchanger can be exceeded. To be able to withstand high internal pressures of in particular the heat exchange medium, it is favourable if a pressure can be applied on the housing of the plate heat exchanger by means of a particularly hydraulic pressure producing means, which pressure corresponds to a low pressure difference relative to the internal pressure of the plate heat exchanger. Therefore, an external pressure is applied on the plate heat exchanger by means of the pressure producing means, which prevents any deflection of the plates to the greatest possible extent. In this connection, the external pressure acts on the plate heat exchanger preferably from all sides, the plate heat exchanger being arranged more or less in a pressure container. In this manner, the stability of the arrangement can be guaranteed with a pressure of up to 350 bar, for instance, when using argon as a heat exchange medium.

To increase the pressure of the working medium in the plate heat exchanger with respect to an improved stability of the arrangement, it is favourable if a working medium space is connected to a compressor, in particular a cylinder piston compressor, so that the volume of the working medium is compressed.

To increase the pressure of the working medium in the plate heat exchanger to a level essentially corresponding to the pressure of the heat exchange medium in the plate heat exchanger, it is of advantage if a liquid channel of the hydraulic pressure producing means, which is arranged to exert pressure on the housing of the plate heat exchanger, branches into a further liquid channel which acts on the cylinder of the cylinder piston compressor. Therefore, the pressure level of the working medium can be adapted to the heat exchange medium, a corresponding external pressure being applied on the housing of the plate heat exchanger via the liquid channel of the hydraulic pressure producing means.

Improvements in the efficiency of the heat exchange can be obtained, if a turbulence producing means to cause turbulences in the flowing working medium is provided in the heat exchange portion of the compression channels or the expansion channels. The flow of the working medium in the heat exchange portion is disturbed by the turbulence producing means, thus causing local turbulences or locally increasing the turbulence, so that the heat exchange is improved with the heat exchange medium.

With respect to obtaining turbulences or backflows in the heat exchange portion of the compression channel and expansion channel in an expedient and constructively easy manner, it is favourable if for a turbulence producing means at least one projection, which is curved in particular and realised in an arcuate form, is provided on a wall of the compression channel and expansion channel, respectively, or profile means on the plates of the plate heat exchanger are provided. Provided that the recesses are milled into the heat exchanger body (e.g. by means of a side and face milling cutter), the projections may be obtained by varying the milling depth.

To increase the efficiency of the device it is favourable if the cross-sectional area of the compression channels and expansion channels extends radially outwards in relation to the rotational axis in a portion downstream of a blade wheel and upstream of the blade wheel, respectively. The flow of the working medium in the cyclic process is maintained by means of the blade wheel which is fixed in particular magnetically close to the rotational axis in the expansion channel. To avoid losses it is favourable if the working medium is introduced into and discharged from the blade wheel at an increased flow velocity, which is achieved by the tapering of the expansion channel in front of the blade wheel or the extension of the compression channel after the blade wheel. In this manner, an optimum entrance and exit angle, respectively, can be achieved in the transition of the working medium into the blade wheel, which substantially increases the efficiency of the system. The decrease—seen in flow direction—in the flow cross-section in the expansion channel in the nature of a nozzle can take place at a relatively short distance without any notable losses. In an increase—seen in flow direction—in the flow cross-section in the compression channel in the nature of a diffuser a distance as long as possible is necessary to minimise losses or increase the efficiency of the diffuser. Advantage is taken of the fact that a comparatively high relative flow velocity is present in the paraxial area and a comparatively low relative flow velocity is present in the abaxial area.

To obtain a backflow-free flow of the working medium in the portions of the compression channels and expansion channels extending outside the heat exchanger body, it is favourable if the compression channels and expansion channels branch radially outwards in relation to the rotational axis at least once into two partial sections, in which sections the respective compression channel and expansion channel is divided into two halves by a partition wall.

When the working medium flows in radial direction, in addition to the centrifugal force causing a compression and expansion, respectively, of the working medium there further occurs the Coriolis force acting transversely to the centrifugal force, so that a pressure side and a suction side is adapted in each compression channel and expansion channel, respectively. To evenly divide the working medium into the partial portions, it is favourable if the partition wall is arranged offset from a centre plane of the compression channel or expansion channel to a suction side of the compression channel or expansion channel, which centre plane extends in parallel to a plane defined by the rotational axis and the flow direction of the working medium. In this case, the working medium in both partial portions has the same velocity profile caused by the Coriolis force.

Uniform division of the working medium into the partial portions may be achieved in a centric arrangement of the partition wall preferably in that the main extension plane of the partition wall is arranged tangentially or perpendicularly to the rotational axis at least for portions. This division of the flow channels in the centre is possible in a constructively simple manner and does not require any complex design.

In a particularly preferred embodiment, it is provided that the main extension plane of the partition wall has a twisted course, an end portion of the main extension plane of the partition wall positioned closer to the rotational axis being arranged essentially tangentially or perpendicularly to the rotational axis and an end portion of the main extension plane of the partition wall being further away from the rotational axis extending essentially in parallel to the rotational axis. Therefore, the working medium is initially equally divided up into the partial portions in the end portion of the partition wall facing the rotational axis and being arranged perpendicularly to the rotational axis. In the partial portions, the partition wall has a course essentially twisted by 90°, so that the main extension plane of the partition wall is arranged in parallel to the rotational axis on the other end portion of the partition wall. Downstream of the partial portions, compression channels and expansion channels, respectively, can branch again; in dependence on the radial dimensions of the respective compression channels and expansion channels, respectively, it is expedient if the compression channels and expansion channel, respectively, branch several times, in particular three times, into portions joining radially outwards, the number of partial portions doubling with each branching.

With regard to a cost-efficient, constructively simple design of the compression channels and expansion channels, respectively, it is favourable if the compression channels and the expansion channels are formed section by section in a heat-insulating rotational body, which is preferably made of plastics. For instance, the rotational body can be manufactured by means of injection moulding.

To obtain a compact, especially stable design of the rotor, it is of advantage if a co-rotating, block-shaped enclosure is provided, in which the heat exchanger body and the rotational body are arranged. The block-shaped enclosure which is preferably made of plastic serves to join the individual parts of the rotor in a rigid, modular arrangement with standing high strain.

In particular with regard to any applicable safety regulations, it is favourable if the block-shaped enclosure is arranged in a stationary external housing. The rotating components inside the device can be arranged with the housing in a sheltered manner. Furthermore, external friction can be minimized by producing a vacuum in said housing.

The method of the above mentioned kind is characterized in that during the heat exchanging process the heat exchange medium is guided adjacent and essentially in parallel to the working medium. Thus, the advantages achieved with the method according to the invention are the same as those achieved with the device according to the invention, so that to avoid repetition reference is made to the statements made above.

To obtain a high efficiency when flowing through the cyclic process, it is favourable if the working medium is compressed essentially adiabatically or expanded adiabatically prior to the heat exchanging process, and in order to avoid or reduce turbulences, an average flow velocity v of the working medium, an angular velocity w of the rotational motion and an extension a of the working medium in tangential direction meeting the correlation $$a \cdot w/v < 1.$$

By observing the above condition, turbulences reducing the efficiency can be avoided or reduced, which turbulences occur whenever a velocity profile of the working medium caused by the Coriolis force, i.e. any imbalance of the velocity distribution transversely to the rotational axis, becomes larger than the average flow velocity v. Accordingly, it may be expedient in particular in the case of minor flow velocities v or high angular speeds w to branch the flowing working medium off into radially joining partial sections, as explained above already.

On the other hand, backflows or turbulences may be desirable during the heat exchange, since the effectiveness of the heat exchange can be increased hereby. Therefore, it is favourable if during the heat exchanging process, to obtain backflows, an average flow velocity v of the working medium, an angular velocity w of the rotational motion and an extension a of the working medium in direction of the rotational axis meet the correlation $$a \cdot w/v > 1.$$

To improve the thermal conduction between the working medium and the heat exchange medium, it has surprisingly turned out to be favourable if the heat exchange medium and the working medium in the heat exchange portion are guided about the rotational axis with the same flow direction. Therefore, the co-current exchange principle is applied in this embodiment, thus minimizing the average temperature difference between the media as compared to the counter-current exchange principle.

With regard to improving the efficiency of the cyclic process, it is an advantage if the pressure in the closed cyclic process is between 10 bar and 150 bar.

To obtain high compression due to the centrifugal force, preferably gases of a low specific heat capacity, in particular a noble gas, preferably argon, krypton or xenon are used as a working medium.

With regard to an efficient heat exchange between the working medium and the heat exchange medium, it is favourable if for heat dissipation and heat supply a heat exchange medium with a high specific heat capacity of at least 1 kJ/(kg*K) and/or an isentropic exponent κ of essentially 1, in particular water, a water-glycol mixture, oil, helium or air is used.

The invention will be illustrated in more detail on the basis of preferred embodiments shown in the drawings. The invention, however, is not intended to be limited to these drawings, in which.

Figure 1:
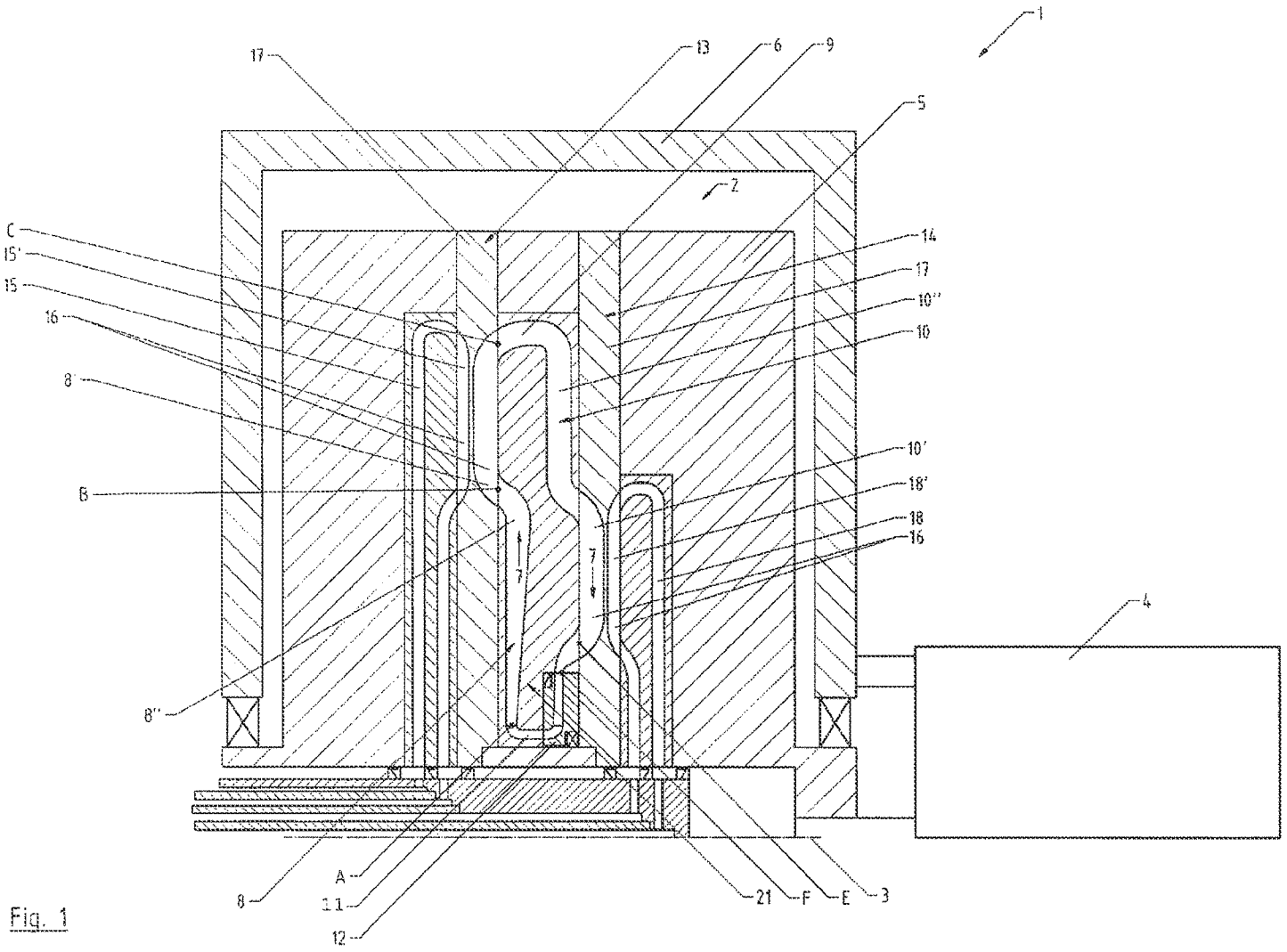
FIG. 1 shows a sectional view of a device for converting thermal energy of low temperature into thermal energy of higher temperature by means of mechanical energy and vice versa in accordance with an embodiment of the invention.

FIG. 1 shows a device 1 according to the invention for converting mechanical energy into thermal energy and vice versa, which is operated as a heat pump in the shown embodiment. The device 1 comprises a rotor 2 driven by a rotational axis 3 of a motor 4. The rotor 2 comprises a block-shaped enclosure 5 which in turn is accommodated in an external, stationary housing 6. A closed flow channel for a working medium passing through a cyclic process is formed within the rotor 2, which working medium exists in a gaseous state during the entire cycle. The working medium, e.g. argon, is guided from a compression channel 8 via a first connection channel 9 into an expansion channel 10 clockwise or in arrow direction 7, which expansion channel is in connection with the compression channel 8 via a second connection portion 11. The compression channel 8 and the expansion channel 10 are each arranged essentially perpendicular to the rotational axis 3, whereas the connection channels 9, 11 extend essentially in parallel to the rotational axis 3. The flow of the working medium is caused or maintained by e.g. a magnetically fixed blade wheel 12, which is arranged close to the rotational axis 3 in the expansion channel 10, in order to keep power dissipation at a minimum.

Due to the rotational motion of the rotor 2, a centrifugal force acts on the working medium flowing radially outwards in the compression channel 8, which centrifugal force causes a pressure increase or temperature increase in the working medium. Likewise, in the expansion channel 10, the centrifugal force acting on the working medium in the direction towards the rotational axis 3 is reduced, thus reducing the pressure or temperature of the working medium. In the heat pump, this fact is made use of to generate different pressure and temperature levels, respectively. Thermal energy of high temperature is withdrawn from the compressed working medium, and thermal energy of comparatively low temperature is supplied to the expanded working medium. For this purpose, two heat exchangers 13, 14 are provided, the one heat exchanger 13 being adapted to dissipate heat from the working medium and the other heat exchanger 14 being adapted to supply heat to the working medium.

In accordance with the invention, the heat exchange takes place partially during compression or expansion via a heat exchange medium co-rotating with the working medium about the rotational axis 3, in that the compression channel 8 and the expansion channel 10 each comprise a heat exchange portion 8', 10', each of which is adapted for a heat exchange with the heat exchangers 13, 14 arranged in a manner co-rotating with the rotor 2; therefore, the heat exchangers 13, 14 are arranged in radial direction perpendicularly to the rotational axis 3. Since the connection channels 9, 11 in the present device 1 are provided only for the deflection of the working medium from the compression channel 8 into expansion channel 10 and vice versa—and not for heat supply or heat dissipation—they may be comparatively short.

For the formation of the heat exchangers 13, 14, a heat exchange channel 15, 18 each carrying the preferably liquid heat exchange medium is provided, which is arranged essentially in parallel to the compression channel and the expansion channel 8, 10 in the area of its respective heat exchange portion 15', 18'. The heat exchange channels 15, 18 and the compression channel 8 and the expansion channel 10, respectively, are formed in the heat exchange portion 8', 10' by means of recesses 16 in a joint, preferably disc-shaped or plate-shaped body 17 of the respective heat exchanger 13, 14, which in connection with FIGS. 4 and 5 will be explained in more detail.

Figure 2:
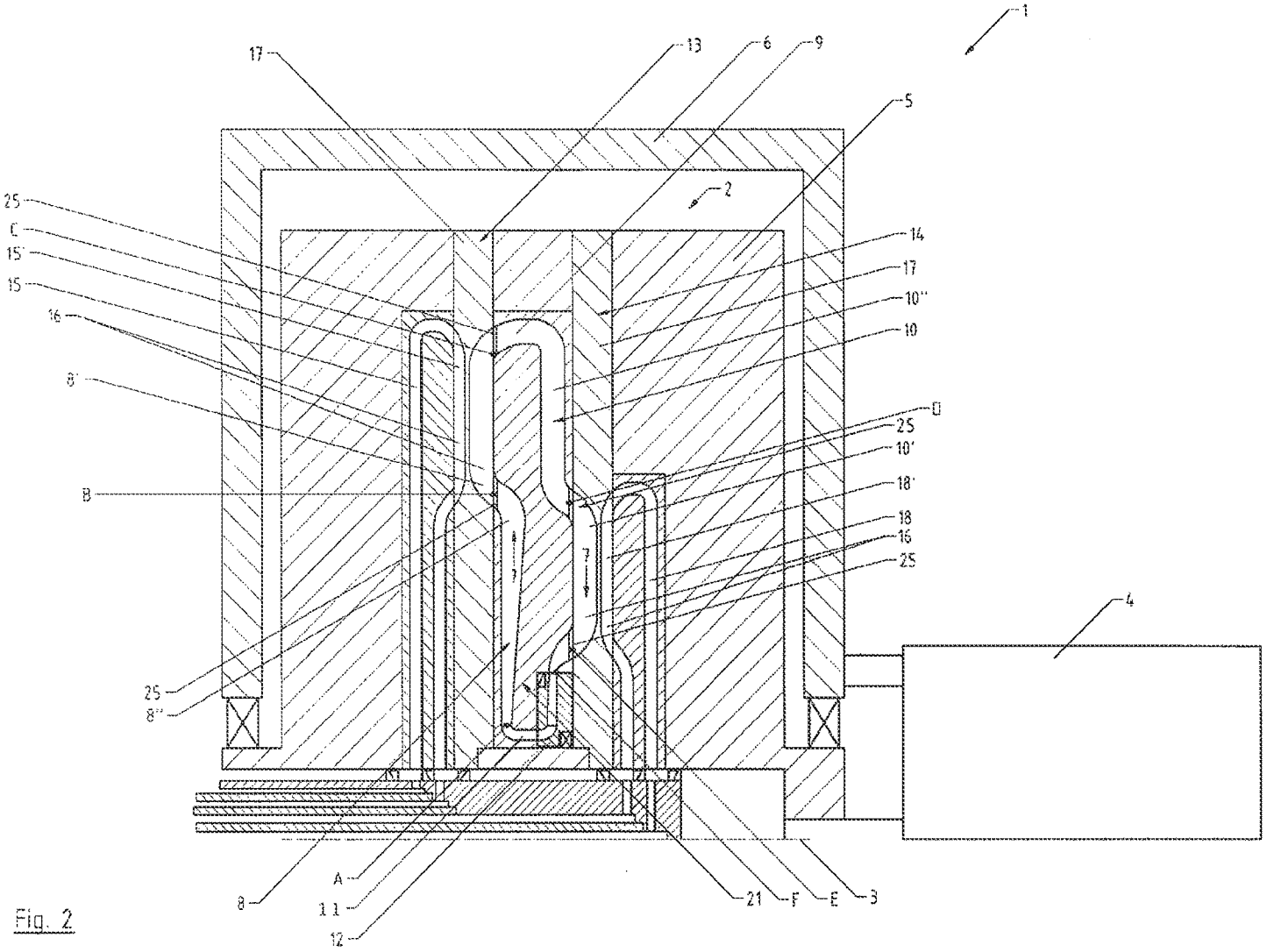
FIG. 2 shows a sectional view of such a device according to a further embodiment of the invention.
Figure 3:
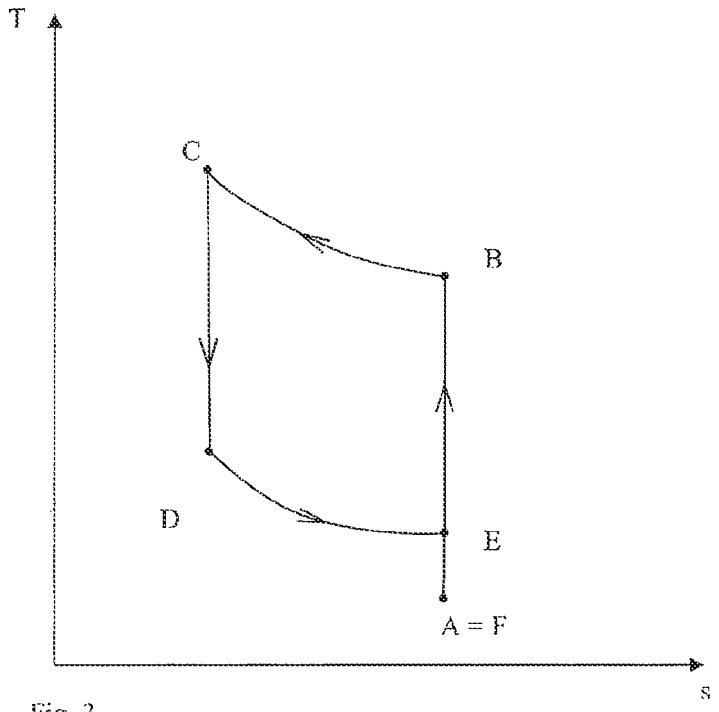
FIG. 3 shows a diagram schematically showing the course of temperature and entropy of the gaseous working medium when passing through the closed cyclic process.

The individual steps in the course of the closed cyclic process, through which the working medium passes along its flow channel in the rotor, may schematically be gathered from the temperature/entropy diagram in FIG. 3, each beginning and end of a step corresponding to a position of the working medium in the flow channel, which is illustrated by letters A to F in FIGS. 1 and 2. Therefore, the working medium is initially compressed essentially adiabatically in a portion 8" of the compression channel 8 from A to B, which portion is spaced from the heat body 13. Subsequently, the working medium enters the recess 16 of the heat exchanger 13, where it dissipates heat to the parallel-guided heat exchange portion 15' of the heat exchange channel 15 in the heat exchange portion 8' of the compression channel 8 from B to C. The working medium is guided via the first connection channel 9 into the expansion channel 10, where it is expanded essentially adiabatically in a portion 10" of the expansion channel 10 from C to D. Subsequent to this, the working medium absorbs heat from the heat exchange medium carried in the heat exchange portion 18' of the heat exchange channel 18 in the heat exchange portion 10' of the expansion channel 10 from D to E. Based on the fact that the blade wheel 12 cannot be joined directly to the heat exchanger 14, a connecting piece is required, which comprises different exit and entrance radii (points E and F), due to which the temperature falls slightly. In the case of adiabatic flow at very low internal flow losses, such an offset does not cause any losses for the entire system, however. Each heat exchange takes place as close a possible to the isothermals, which cannot quite be achieved under real conditions, said unavoidable deviations being shown in the diagram of FIG. 2 in exaggerated form. The flow energy of the working medium in the closed flow channel which extends completely within the rotor 2 remains approximately constant during the cyclic process, except for comparatively minor losses that are caused by friction of the flow on the channel wall as well as internal frictions of the flow, thus achieving a high efficiency. The pressure of the working medium is between 10 and 150 bar when passing through the cyclic process.

To operate the shown device 1 as a heat engine, the cyclic process is passed through in reversed direction, in which connection a generator instead of a motor 4 driving the rotor 2 is provided. In this embodiment, heat is supplied at a comparatively high temperature in the heat exchanger 13, and heat is discharged at a comparatively low temperature in the heat exchanger 14.

Figure 4:
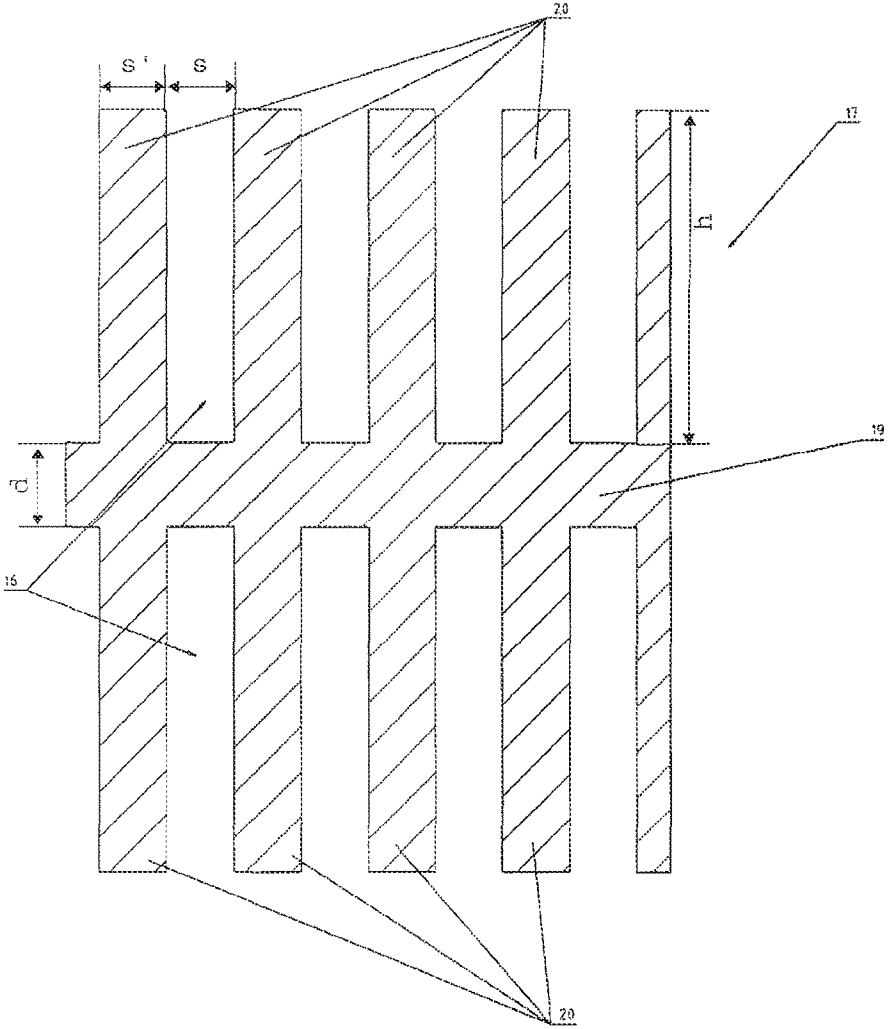
FIG. 4 shows a schematic sectional view of a portion of a heat exchanger according to the invention, in which the fins project from an all-over wall on both sides.
Figure 5:
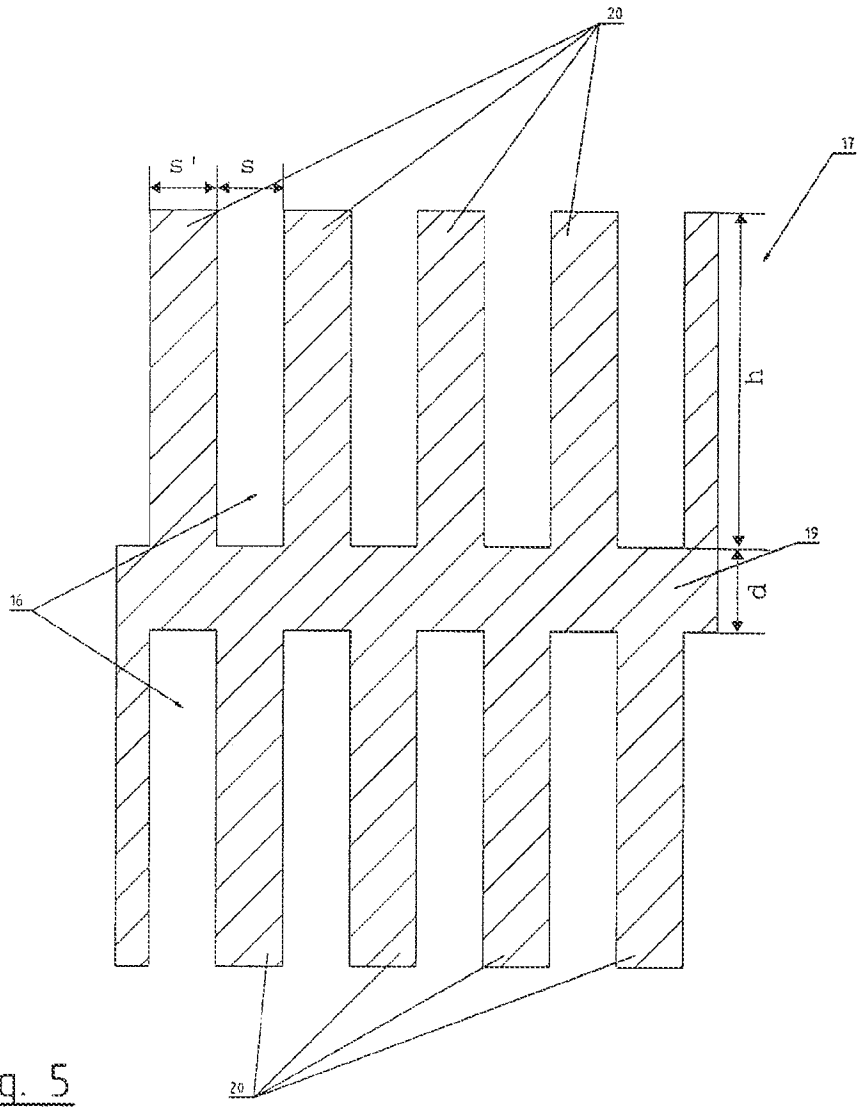
FIG. 5 shows a schematic sectional view of the heat exchanger according to FIG. 4, in which the fins are arranged on opposite sides offset against each other.

As can be seen in FIG. 4 and FIG. 5, preferably a plurality of heat exchange channels 15, 18 of the heat exchangers 13, 14, which heat exchange channels are arranged symmetrically about the rotational axis at regular angular distances, as well as a plurality of compression channels 8 and expansion channel 10, respectively, (cf. FIG. 6) are provided, which are formed in corresponding recesses 16 of the disc-shaped or plate-shaped heat exchanger body 17 in heat exchange portions 8', 10', 15', 18'.

In a preferred embodiment of the invention, exactly one recess 16 of the heat exchanger body 17 is allocated to each compression channel 8 and each expansion channel 10, respectively, in the corresponding heat exchange portion 8', 10'. In some cases, however, it may be expedient to deviate from this configuration, so that the number of compression channels 8 and expansion channels 10, respectively, no longer matches the number of recesses 16 in the heat exchanger body 17.

In FIG. 2, such a variant is schematically illustrated in that on the transitions to the heat exchange portion 8' of the compression channel 8—and correspondingly on the transitions to the expansion channel 10—schematically annular distribution grooves 25 are indicated, with which contact is made between a compression channel 8 and an expansion channel 10, respectively, and at least two recesses 16 of the surfaces of the heat exchangers 13 14, which limit the heat exchanger body.

FIGS. 4 and 5 schematically show a section of the heat exchanger body 17 according to the invention, which is formed by a disc or a plate made of aluminium, which combines a very good thermal conductivity with a high rigidity. The heat exchanger body 17 comprises a central all-over wall 19, whose main extension plane is arranged perpendicularly to the rotational axis 3. Fins 20 are produced by milling, between which fins—in the case of the heat exchanger 13 allocated to the compression channel 8—recesses 16 for the heat exchange channels 15 are provided on the one side, and recesses 16 for the compression channels 8 in the heat exchange portion 8' are provided on the other side. The heat exchanger 14 allocated to the expansion channel 10 is constructed analogically.

The all-over wall 19 of the heat exchanger body 17 can be designed thin-walled to obtain an efficient heat transfer without impairing the stability, the wall thickness d amounting to about 1 to 5 mm by taking the stability into consideration. The width s' of the fins 20, i.e. their extension perpendicular to the rotational axis 3, essentially corresponds to the width s of the recesses 16 perpendicular to the rotational axis 3. The ratio between the longitudinal extension h of a fin 20, i.e. its extension in the direction of the rotational axis 3, and its width s' is about 1 to 20. With the groove width (channel width) and the number of fins staying the same, the width s, s' is continuously increased in radial direction.

The embodiment of the heat exchanger body 17 shown in FIG. 5 differs from that according to FIG. 4 in that the fins 20 or the recesses 16 of the heat exchanger body 17 are arranged in a manner offset to one another in a direction perpendicular to the rotational axis 3. The offset exactly corresponds to the width s of a recess 16 or s' of a fin 20, so that in each case a fin 20 and a recess 16 are opposite each other. With this arrangement, the heat conduction losses in the heat exchangers 13, 14 can be reduced and the strength concerning differential pressures can be improved. In the case that the longitudinal extension h of the fins 20 is larger than their width s', an improvement in heat conduction is achieved exactly when the wall thickness d of the wall 19 is larger than or equal to the width s' of the fins 20. An improvement in the thermal conductivity is achieved in any case, if the longitudinal extension h of the fins 20 is smaller than or equal to the width s'. These correlations apply particularly in the paraxial area, if comparatively small diameters are given.

Figure 6:
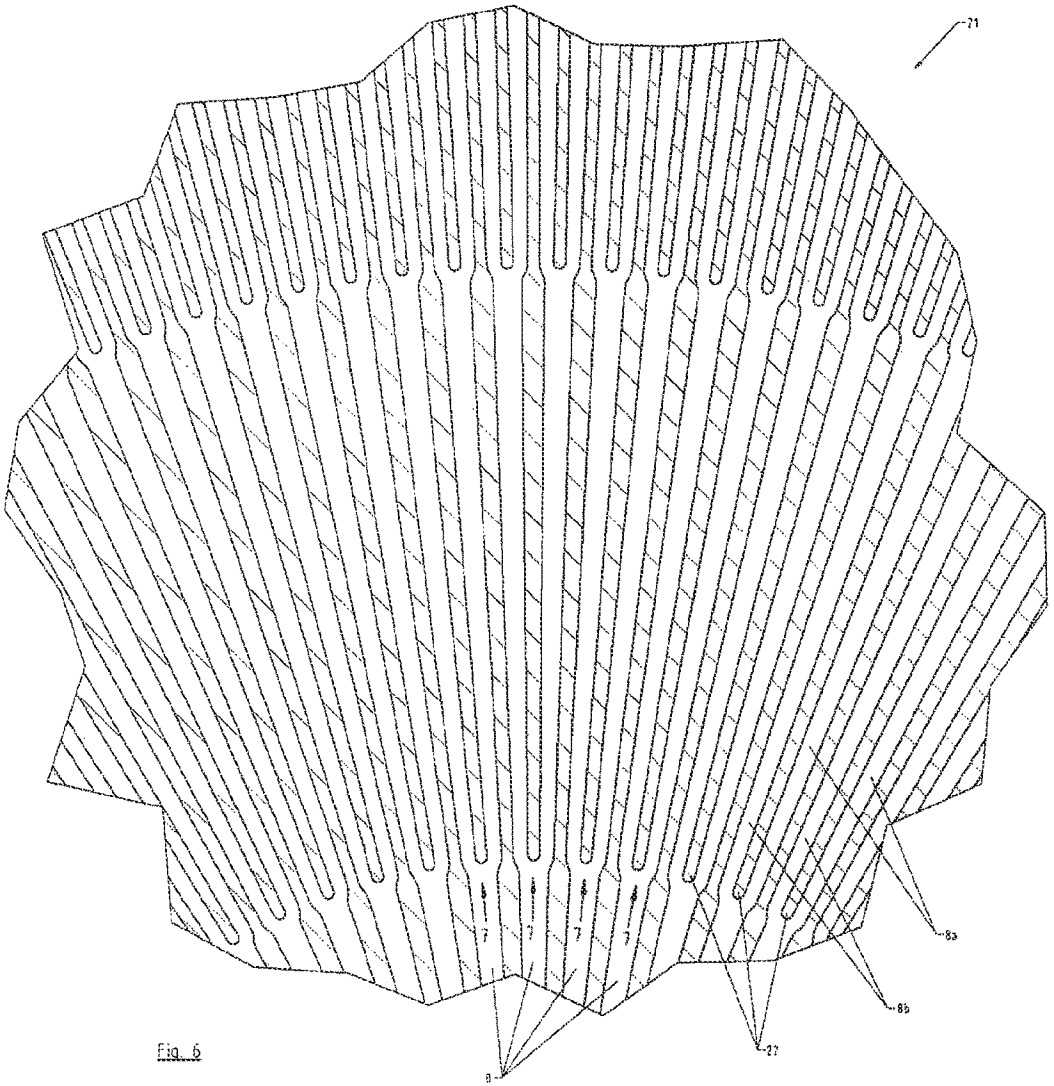
FIG. 6 shows a schematic sectional view of a portion of a rotational body comprising a plurality of compression channels and expansion channels, respectively, that are arranged at regular angular distances.

FIG. 6 schematically shows a sectional view of a section of a rotational body 21 preferably made of plastic, in which a plurality of compression channels 8 arranged at regular angular distances relative to the rotational axis 3 are formed. Correspondingly, the expansion channels 10 are arranged on the opposite side of the plate-shaped rotational body 21, as can be seen from the sectional view of the device 1 according to FIG. 1 and FIG. 2.

The working medium flowing radially outwards in the compression channels 8 in the arrow direction 7 is exposed to the Coriolis force which acts in a direction perpendicularly to the angular speed w or the flow in the arrow direction 7, i.e. essentially perpendicularly to the rotation axis 3. In this manner, a velocity profile schematically illustrated with the arrows in FIG. 9 occurs in the compression channels 8 (and correspondingly in the expansion channels 10), the flow velocity v of the working medium continuously increasing from a pressure[s] side towards a suction side.

To avoid backflows in the compression channels 8 and the expansion channels 10, respectively, which may occur if a mean flow velocity v of the working medium, an angular speed w of the rotational motion and an extension a of the working medium in tangential direction meet the correlation $$a \cdot w / v > 1,$$

the compression channels and the expansion channels 8, 10 each have a profile widened radially outwards relative to the rotational axis 3, as can be seen from FIG. 6.

To avoid backflows over the entire radial extension of the compression channels 8 and the expansion channels 10, respectively, the compression channels 8 (and accordingly the expansion channels 10) are repeatedly branching into partial portions 8*a*, 8*b*, separated by partition walls 22, relative to the rotation axis 3 radially outwards.

In the central arrangement of the partition walls 22 in the compression channels 8 and expansion channels 10 shown in FIG. 6, the working medium is not split up equally between the two halves, since the working medium guided into the one half comprises a part of the velocity profile caused by the Coriolis force that comprises the pressure side, and the working medium guided into the other half comprises the part of the velocity profile comprising the suction side—in which the flow velocity is on average higher.

An equal division of the working medium on the transition into the partial portions of a compression channel 8 and an expansion channel 10, respectively, may take place in particular in two ways.

On the one hand, a partition wall 22 arranged in parallel to the rotational axis 3 can be arranged offset from a centre plane of the compression channels and expansion channels 8, 10, which centre plane extends in parallel to the rotational axis 3, towards a suction side of the compression channel 8 and the expansion channel 10. In this manner, the flows carried in the partial portions 8*a*, 8*b* have the same velocity profile.

Figure 7:
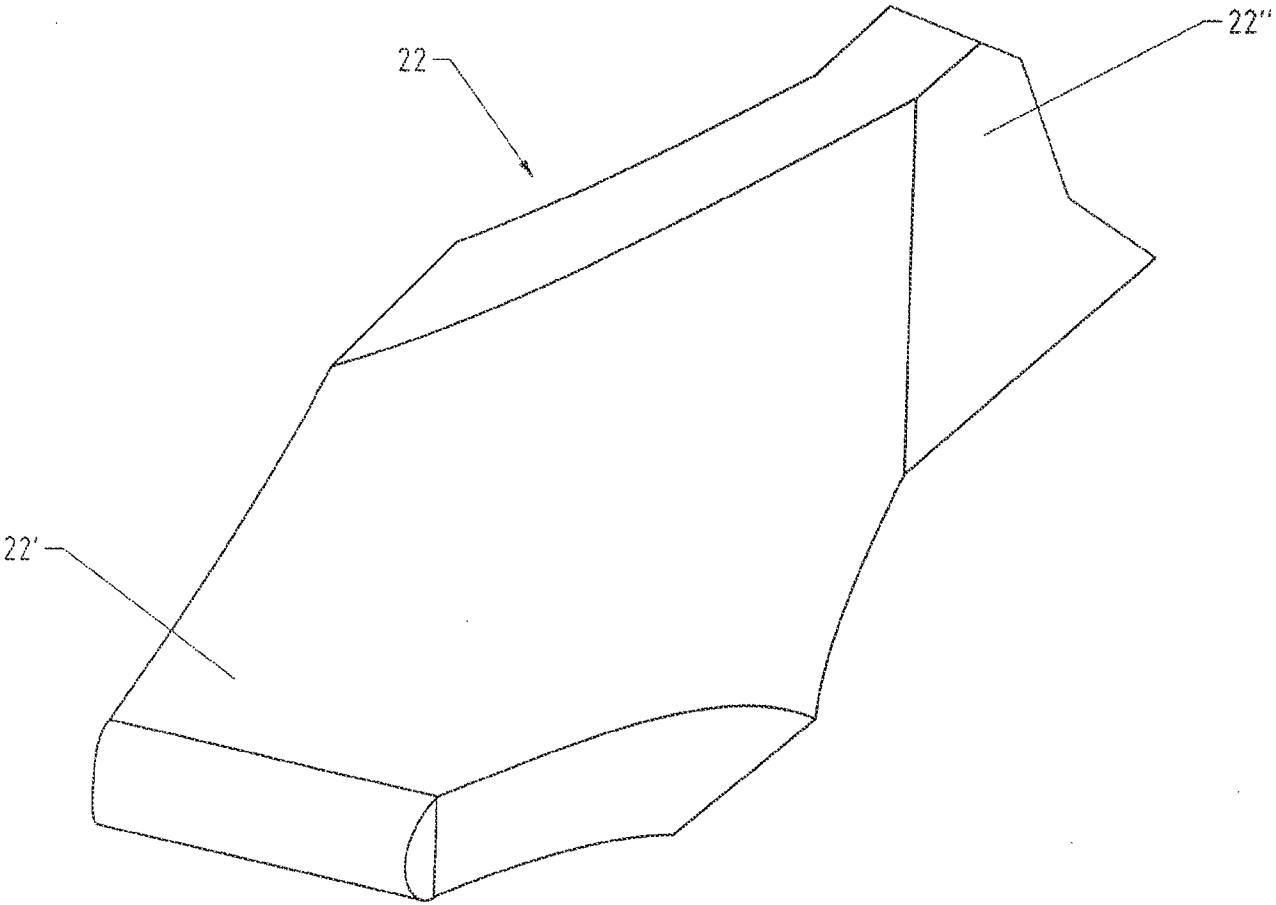
FIG. 7 shows a perspective view schematically showing a twisted course of a partition wall arranged in the compression channel or the expansion channel.
Figure 8:
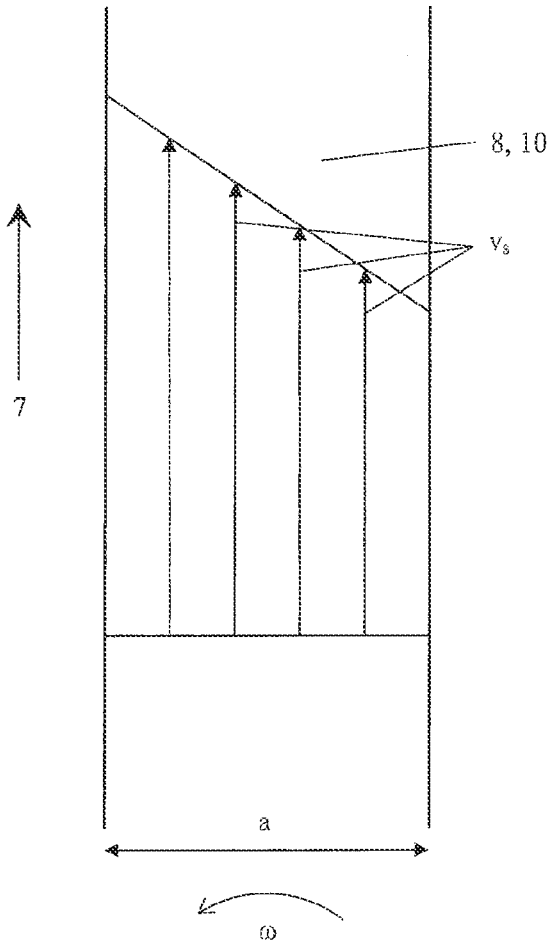
FIG. 8 shows a schematic view of a compression channel or an expansion channel, illustrating a velocity profile of the working medium caused by the Coriolis force.

Alternatively thereto, the main extension plane of each partition wall 22 can be arranged perpendicularly to the rotational axis 3 at least section by section, to evenly divide the gas flows. An embodiment of the partition wall 22, which is schematically shown in FIG. 7, is shown to be particularly advantageous. In this connection, the main extension plane of the partition wall 22 shows a twisted course. An end portion 22' of the main extension plane of the partition wall 22 is arranged perpendicularly to the rotational axis 3, which end portion faces the rotational axis 3. Adjacent thereto, the partition wall 22 extends in a manner twisted by overall 90°, the other end portion 22" of the main extension plane of the partition wall 22 extending essentially in parallel to the rotational axis 3. In this embodiment, it is not necessary that the end portions 22', 22" of the partition wall 22 are arranged in a manner arranged offset from the centre planes extending in parallel to or perpendicularly to the rotational axis 3.

Figure 9:
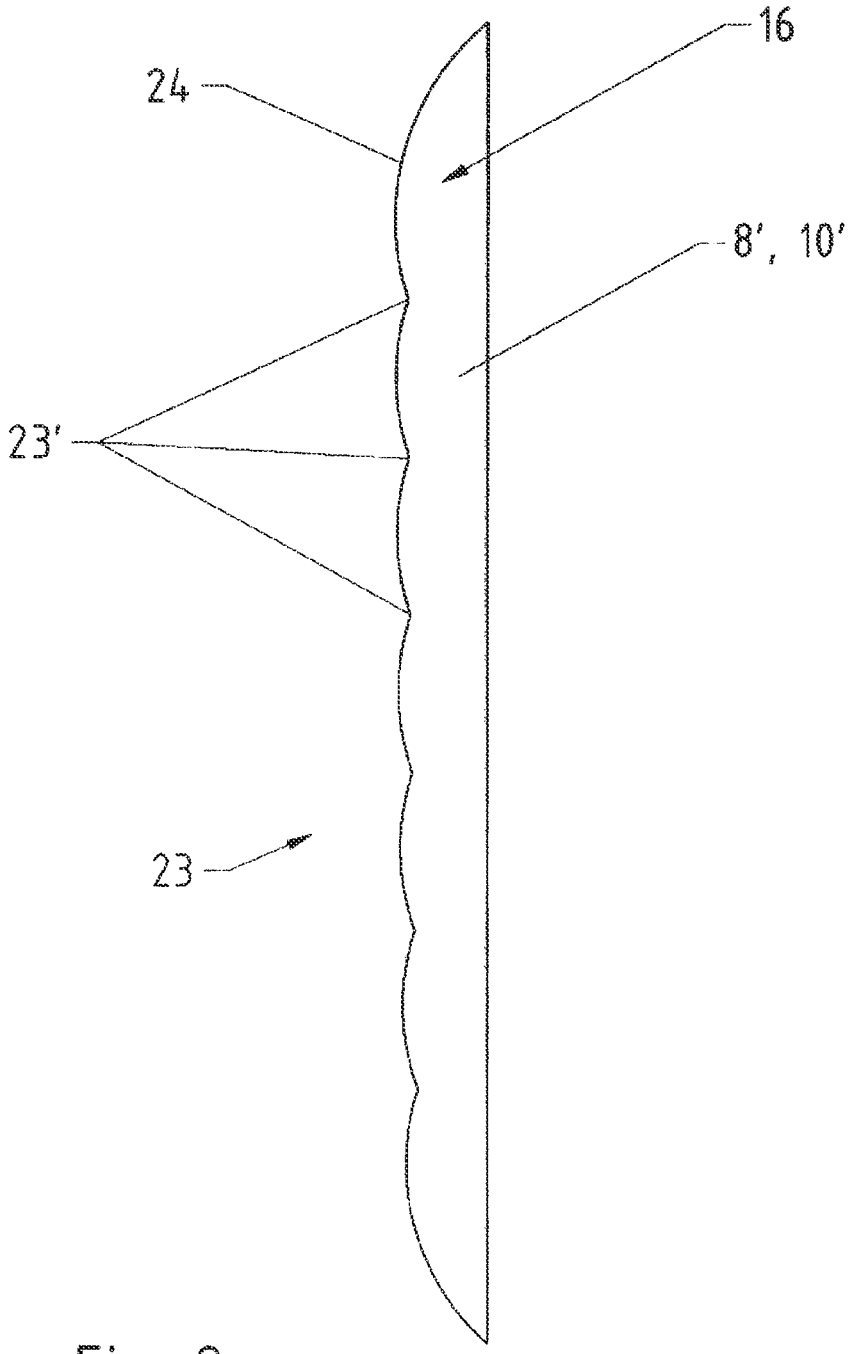
FIG. 9 shows a schematic view of a heat exchange portion of a compression channel or an expansion channel, in which projections are provided on the wall to produce turbulences in the flowing working medium.

As compared to the portions 8", 10" of the compression channels 8 and expansion channels 10, respectively, which portions extend outside the heat exchanger body 17, the occurrence of turbulences or backflows in the heat exchange portions 8', 10' may be desired. For this purpose, the compression channels 8 and the expansion channels 10, respectively, in the heat exchange portions 8', 10' may comprise a turbulence producing means 23, with which turbulences can be generated deliberately in the working medium flowing in the recesses 16 of the heat exchanger body 17. As shown in FIG. 9, this can be effected in a constructively simple manner by means of arcuate-shaped, curved projections 23' on a wall 24 of the compression channels 8 and the expansion channels 10, respectively. The projections 23' can be provided in an uncomplicated manner by means of different milling depths during milling the recesses 16 into the heat exchanger body 17. In addition, such turbulators can easily be manufactured by casting methods.

Figure 10:
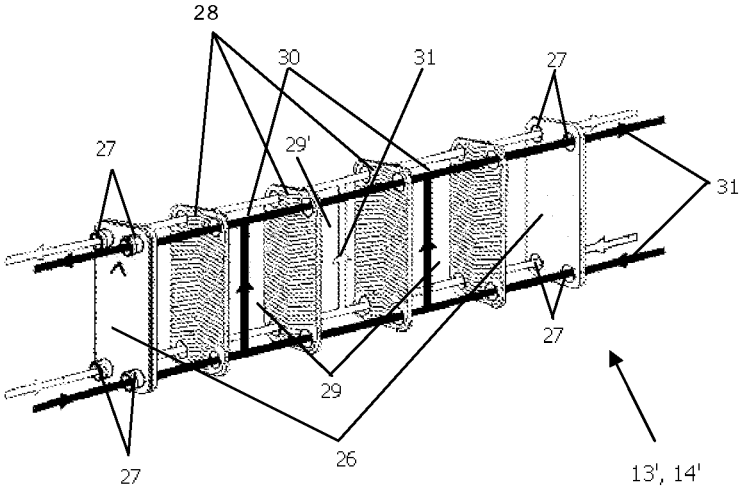
FIG. 10 shows an exploded perspective view of a plate heat exchanger.

In another embodiment of the invention, a plate heat exchanger 13', 14' is provided each as heat exchanger 13, 14, whose basic principle can be seen from FIG. 10.

The plate heat exchanger 13', 14' schematically shown in FIG. 10 comprises a two-piece housing 26 with connections 27, in which housing e.g. four profiled plates 28 are arranged in a manner separated by spaces 29, 29'. The working medium schematically illustrated by arrows 30 flows in the spaces 29. The heat exchange medium is guided in the space 29' as indicated by arrows 31. Therefore, spaces 29 for the working medium and spaces 29' for the heat exchange medium are alternating. Of course, the sequence of spaces 29, 29' may be reversed. In addition, an embodiment is possible, in which the connections 27 are provided on one housing part only. The plates 28 are soldered or screwed together.

Figure 11:
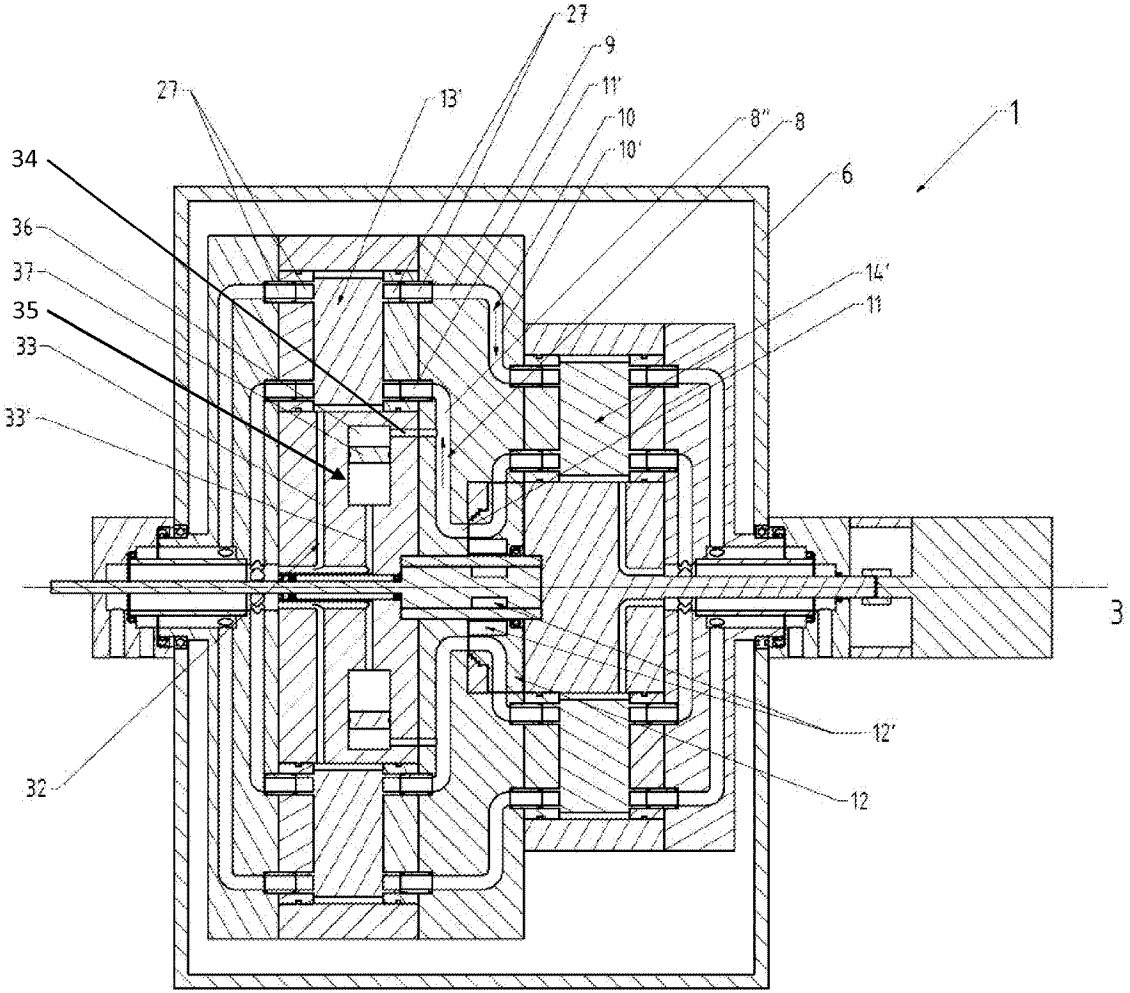
FIG. 11 shows an embodiment of the device according to the invention, in which plate heat exchangers according to FIG. 10 are provided.

FIG. 11 shows an embodiment of the device 1 with plate heat exchangers 13', 14', whose construction basically corresponds to that of the plate heat exchanger 13', 14' illustrated on the basis of FIG. 10. The connections 27 for the working medium or the heat exchange medium, however, are provided on opposite sides. To avoid repetition, only those features of device 1 which are different as compared to the embodiment according to FIG. 1 or FIG. 2 are to be dealt with below.

The heat exchangers 13', 14' are arranged in the device 1 in such a manner that their plates 28 extend essentially perpendicularly to the rotational axis 3. Therefore, in this embodiment of the invention, too, a heat exchange takes place in radial direction. The working medium flows from portion 8" of the compression channel 8 via a short horizontal connection piece 11' and the corresponding connection 27 into the heat exchanger 13', in which the spaces 29 act as radially extending heat exchange portions 8'. The adjacent spaces 29', in which the heat exchange medium is flowing, serve as radially arranged heat exchange portions 15' of the plate heat exchanger 13'. Subsequently, the working medium leaves the plate heat exchanger 13' and is guided into the second heat exchanger 14' via the connection channel 9 and the expansion channel 10, respectively. To maintain the flow of the working medium in the cyclic process, the blade wheel 12 fixed via magnets 12' is provided.

To adapt the plate heat exchanger 13' with respect to the high pressures, in particular, of the heat exchange medium, the housing 26 of the plate heat exchanger 13' is connected to a hydraulic pressure producing means 32, with which an external pressure can be exerted on the housing 26 of the plate heat exchanger 13' via a liquid channel 33 on which pressure can be applied with the means not shown in the Figures (e.g. a cylinder piston linear drive). A corresponding pressure producing means 32 (not shown) can be allocated to the heat exchanger 14'; thus, the same considerations apply for this heat exchanger. The pressure exerted on the housing 26 of the plate heat exchanger 13' by means of the pressure producing means 32 essentially corresponds to the internal pressure of the plate heat exchanger 13', to avoid any deformations of the plates 28 impairing the stability of the arrangement.

To adapt the pressure of the working medium in the plate heat exchanger 13' to the pressure of the heat exchange medium, a portion of the compression channel 8 preceding the plate heat exchanger 13' comprises a connection channel 34 to a compressor 35 with a cylinder 36 and a piston 37. The piston 37 is actuated by a liquid channel 33' branching off from the liquid channel 33 of the pressure producing means 32, to compress the working medium in the entire gas cycle, in which the entire volume of the gas cycle is reduced. Thus, the piston 37 and the housing 26 of the plate heat exchanger 13' can be simultaneously supplied with appropriate pressures via the pressure producing means 32, to reliably reduce pressure differences in the plate heat exchanger 13'. The piston 37 can also be replaced by a membrane (not shown).

Figure 12:
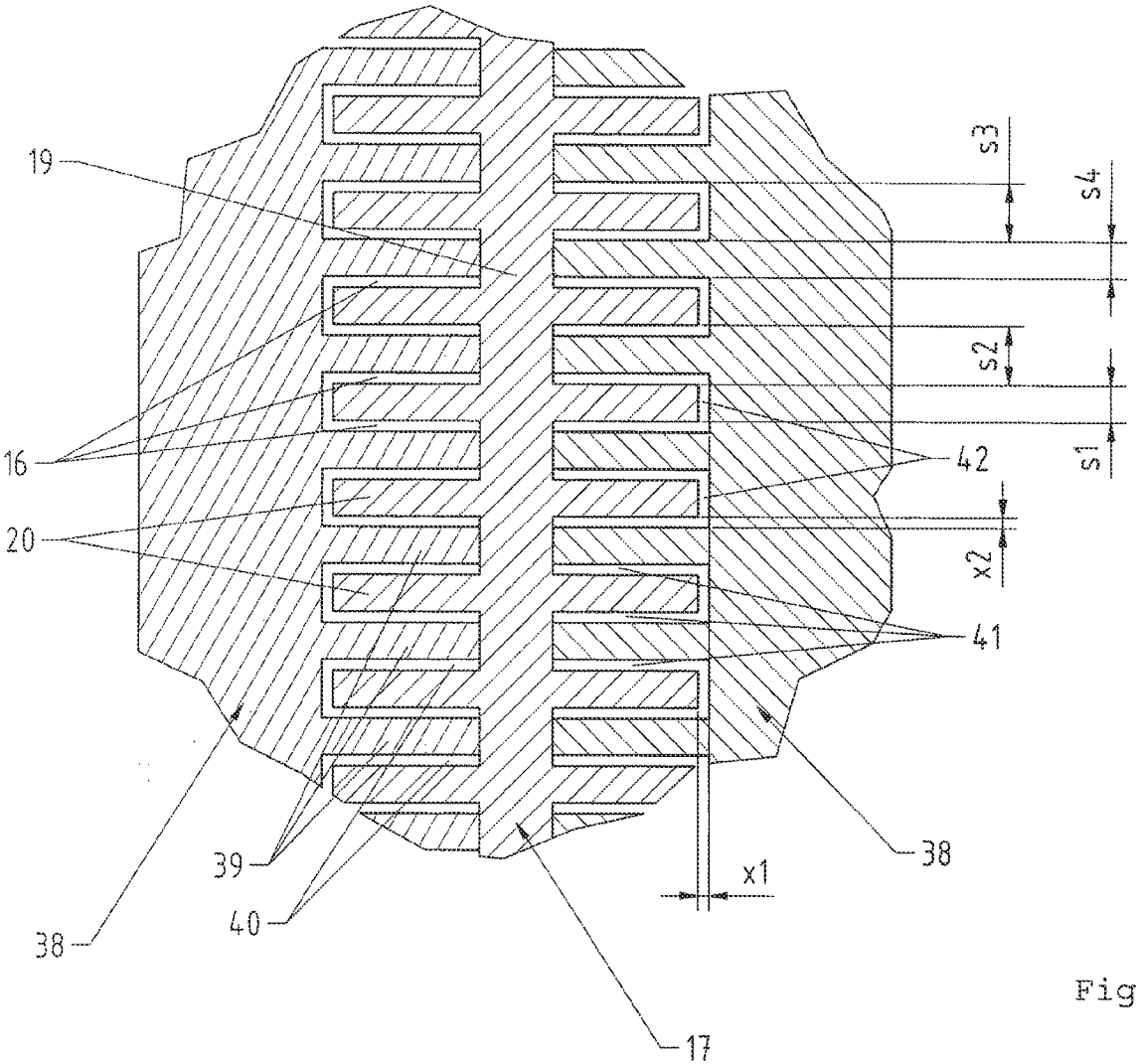
FIG. 12 shows a schematic sectional view of an alternative heat exchanger with counter-plates.

FIG. 12 shows an alternative embodiment of the heat exchanger 13, 14, which is a further development of the heat exchanger body 17 shown in FIG. 4 and FIG. 5. To realise a better heat exchange between the working medium and the heat exchange medium, counter-plates 38 with fins 39 engage in the recesses 16 between the fins 20 of the heat exchanger body 17. The widths s1 and s4 of the fins 20 of the heat exchanger body 17 and of the fins 39 of the counter-plates 38, respectively, amount to an optimum range of 1 to 10 mm. The widths s2 and s3 of the recesses 16 of the heat exchanger body 17 and of corresponding recesses 40 of the counter-plates 38, respectively, are each 0.5 to 15 mm wider than the fins 39 and 20 projecting into said recesses. This results into flow channel widths x2 of 0.25 to 7.5 mm. Due to these comparatively small gap widths, correspondingly small hydraulic diameters are realised, due to which the heat transfer from the medium to the adjacent walls is increased considerably. To ensure uniform flow, a gap 41 or 42 is left on both sides of the fins 20 and on the front sides of the fins 20, the widths x1 and x2 of the gaps are approximately equal in size. In addition, the gap 42 ensures that the fins 39 projecting into are pressed against the heat exchanger body 17, thus enabling a large heat transfer.

The invention claimed is:

1. A method for converting thermal energy of low temperature into thermal energy of higher temperature by means of mechanical energy and vice versa, comprising a working medium that rotates about a rotational axis, which working medium passes through a closed thermodynamic cyclic process, the working medium being guided essentially radially outwards during compression in a compression channel with respect to the rotational axis and radially inwards during expansion in an expansion channel with respect to the rotational axis, whereby a pressure increase or a pressure decrease in the working medium is generated by the centrifugal force acting on the working medium, and the working medium dissipates heat to a heat exchange medium or receives heat from a heat exchange medium, wherein the heat exchange medium co-rotates with the working medium about the rotational axis wherein the heat exchange between the working medium and the heat exchange medium takes place at least partially during compression or expansion of the working medium, wherein during the heat exchange the heat exchange medium is guided adjacent and essentially in parallel to the working medium, wherein the cross-sectional area of the compression channel and expansion channel, respectively, increases radially outwards in relation to the rotational axis in a portion downstream of a blade wheel and upstream of the blade wheel, respectively, wherein the compression channel and expansion channel, respectively, branch radially outwards in relation to the rotational axis at least once into two partial sections, in which partial sections the compression channel and expansion channel, respectively, are divided into two halves by a partition wall.

2. The method according to claim 1, characterized in that the working medium is compressed essentially adiabatically or expanded adiabatically prior to the heat exchanging process, to avoid or reduce backflows or turbulences, an average flow velocity v of the working medium, an angular velocity w of the rotational motion and a width a of the working medium in the associated channel in a tangential direction to the rotational motion meeting the correlation $$a \cdot w/v < 1.$$

3. The method according to claim 1, characterized in that during the heat exchanging process, to obtain backflows or turbulences, an average flow velocity v of the working medium, an angular velocity w of the rotational motion and a width a of the working medium in the associated channel in tangential direction to the rotational motion meets the correlation $$a \cdot w/v > 1.$$

4. The method according claim 1, characterized in that the pressure in the closed cyclic process amounts to between 10 bar and 150 bar.

5. The method according to claim 1, characterized in that a noble gas, preferably argon, krypton or xenon is used as a working medium.

6. The method according to claim 1, characterized in that for heat dissipation and heat supply, a heat exchange medium with a high specific heat capacity of at least 1 kJ/(kg*K) or an isentropic exponent κ of essentially 1, in particular water, a water-glycol mixture, oil, helium or air is used.

* * * * *